United States Patent [19]

Mohr et al.

[11] 4,445,409

[45] May 1, 1984

[54] DEVICE FOR CUTTING PAPER, CARDBOARD, AND SIMILAR MATERIALS

[76] Inventors: Karl Mohr, Hattersheimer Str. 11; Wolfgang Mohr, Hundshager Weg 42, both of 6238 Hofheim, Fed. Rep. of Germany

[21] Appl. No.: 336,825

[22] Filed: Jan. 4, 1982

[30] Foreign Application Priority Data

Jan. 22, 1981 [DE] Fed. Rep. of Germany ..... 3101911

[51] Int. Cl.[3] ..... B26D 5/00

[52] U.S. Cl. ..... 83/157

[58] Field of Search ..... 83/36, 96, 104, 106, 83/109, 100, 165, 157, 168, 167, 163, 207, 249, 467 A, 112, 373; 269/302.1, 289 R

[56] References Cited

U.S. PATENT DOCUMENTS

| | | | |
|---|---|---|---|
| 3,598,007 | 8/1971 | Williams | 83/36 |
| 3,646,842 | 3/1972 | Keck | 83/104 |
| 3,830,121 | 8/1974 | Makeev | 83/106 |
| 3,916,742 | 11/1975 | Biernot et al. | 83/157 |
| 4,040,318 | 8/1977 | Makeev et al. | 83/157 |
| 4,048,888 | 9/1977 | Bonnard et al. | 83/100 |
| 4,300,420 | 11/1981 | Haenni | 83/157 |

FOREIGN PATENT DOCUMENTS

| | | | |
|---|---|---|---|
| 1107484 | 5/1961 | Fed. Rep. of Germany | 83/467 A |

*Primary Examiner*—E. R. Kazenske
*Assistant Examiner*—Paul M. Heyrana, Sr.
*Attorney, Agent, or Firm*—Max Fogiel

[57] ABSTRACT

A device for cutting paper, cardboard, and similar materials in which the material to be cut is advanced to the desired extent along a cutting table by a feed mechanism and in which an intermediate cut is carried out both when the edges are trimmed and subsequent to one or more main cuts. The device eliminates the necessity of manually removing the waste paper resulting from edge trimming and intermediate cutting. This is made possible by a cutting table consisting of a front part (1) on which the trimmed material (20) rests and a rear table (2) on which the material (3) to be trimmed rests, with the front (1) and rear (2) parts sliding apart to leave a gap (10).

12 Claims, 8 Drawing Figures

DEVICE FOR CUTTING PAPER, CARDBOARD, AND SIMILAR MATERIALS

Figure 1:
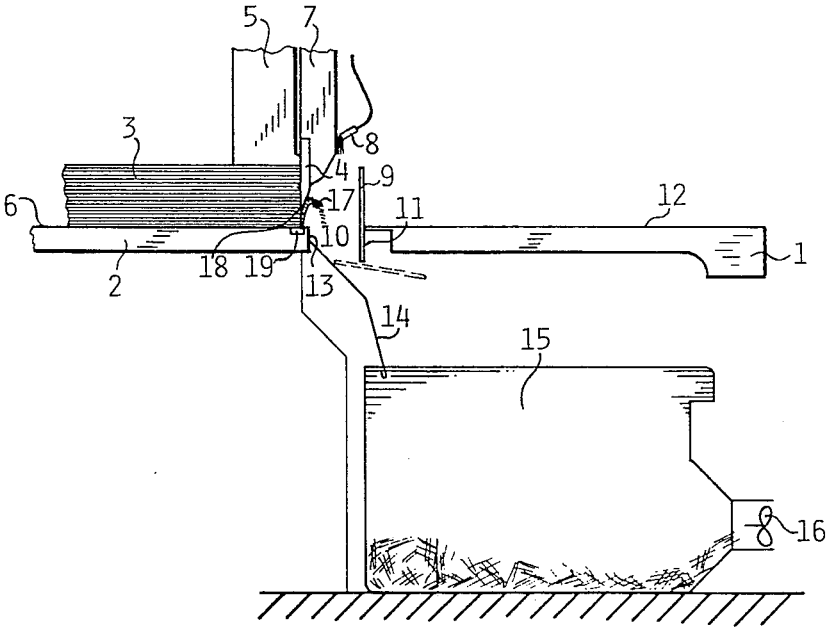

The invention is a device for cutting paper, cardboard, and similar materials in which the material to be cut is advanced to the desired extent along a cutting table by a feed mechanism and in which an intermediate cut is carried out both when the edges are trimmed and subsequent to one or more main cuts.

In devices that trim stacked sheets, especially collated sheets, of paper, cardboard, and similar materials, the stack must be advanced very precisely under the knife to ensure that the stack is trimmed exactly along the desired line. Even slight displacements, like measurement errors resulting from paper delay can cause the knife to trim at a position off the desired line. When the sheets have been collated, this can even make the knife cut into the printed matter. Collated sheets are therefore printed, not with the printed areas immediately next to each other, but with intervals left between them. It is of course possible to make inside cuts between the main cuts to prevent cutting into the printed areas. Similarly, the edges can be trimmed before the stacks themselves are cut. The advantage of this method is that, once its edges have been trimmed, the stack will have a defined form and dimensions, which will have a decisive effect on the subsequent main cut.

When setting up for both edge trimming and intermediate cutting, it is more economical to adjust the machine to keep the strips of paper that will be left over as waste as narrow as possible. In practice, the width of such strips will range approximatly from 1.5 to 2.0 mm. They must be removed by hand. When collated sheets are trimmed, for example, the waste is usually removed after the collated sheets have been completely cut. Thus, once the stack has been cut into smaller stacks, the waste strips will be left between them, leaving extra work. This will consist of sliding the stacks apart, removing the waste, and sliding the stacks together again. First, this extra work is very inconvenient, and, second, even the most experienced worker will not usually be able to slide the stacks together again accurately, which will make subsequent handling very difficult.

The present invention is a device of the type described in the introduction in which the waste paper resulting from edge trimming and intermediate cutting will not have to be removed manually.

The invention fulfills its purpose essentially in that it has a two-part cutting table consisting of a front part on which the trimmed material rests and a rear part on which the material to be trimmed rests, with the front and rear parts sliding apart to leave a gap.

The invention allows the strips of waste paper left over from trimming to fall through this gap, removing them without manual intervention. This saves the workers a lot of labor. Since he will no longer have to remove the paper himself, he will be totally freed from participation in the trimming process and will mainly be responsible for supervision or can devote himself to other duties. In addition to saving labor, the invention makes trimming much more economical.

In one particular embodiment of the invention, the two parts of the cutting table slide apart before the edges are trimmed and the intermediate cut made.

Another advantage is that the width of the gap that occurs when the two parts of the table are separated can be varied in such a way as to be a multiple of the width of the waste strips that result from both edge trimming and intermediate cutting. This helps the strips to fall through the gap unobstructedly.

In another embodiment of the invention the front part of the cutting table can be raised at a right angle to the cutting surface of the rear part. This can be done mechanically, hydraulically, or pneumatically.

It is practical to match the displacement of the front part of the table to the different stages of the trimming process. Ideally, the device will be completely automatic, with the operator completely relieved or any subsidiary intervention and largely performing supervisory functions.

Another embodiment of the invention incorporates a straightedge that is positioned under the front part of the table at the plane of separation between the two parts when they are together. When the two parts separate, the straightedge moves from this rest position into an operating position where it lies in contact with the total length of the rear edge of the front part of the table and at a right angle to the table's upper surface. When this straightedge is in the operating position, it prevents the knife from throwing waste onto the front part of the table when brittle material is being cut. While it is moving into its operating position, it pushes the rear of the last stack to be cut completely onto the front part of the table and prevents any sheets from getting stuck in the closing gap. Finally, in the operating position, it permits the operator to use an operating square to fully automatically straighten any trimmed stacks that have been shoved together as a result of the form of the knife.

The front part of the table in the invention also has a removable board on which the trimmed stack rests. The stack is thus not lifted off the table by itself but transported on the board to the next operation.

The waste paper that falls through the gap slides down a sheet-metal guide into a receptacle under the plane of separation, where it is collected. This guide should have a folding section in the neighborhood of the front edge of the rear part of the table for registering the material that is to be cut and that rests on the rear part of the table. It is practical to register the material that is to be trimmed because, during preliminary clamping and trimming, it can get displaced more or less in accordance with its materials properties and especially in the vicinity of the clamping bar from the front surface of the feed mechanism, which determines format. Unless it is registered, the bottom sheets of the stack to be trimmed whould be in contact with the front surface of the moving feed mechanism, but the upper part of the stack would lean away. If such were the case, the subsequent labels would be inaccurately cut. When the folding section at the front edge of the rear part of the table is folded up, it will force the whole front surface of the stack to be trimmed against the feed mechanism. It is practical for such a folding section to knock several times briefly against the stack, especially when the material is rough-surfaced, to jog the layers of material into register.

The stack should be registered after the front and rear parts of the table have been separated, the straightedge is in the operating position, and the strips of waste resulting from either trimming or cutting have been conveyed into the gap by the forward motion of the fed mechanism. Registration should also be automatic and in sequence with cutting.

It is practical to connect the waste receptacle to a suction or transport device to help remove the waste.

To prevent waste from sticking to the knife so that it does not fall into the gap between the trimmed and separated stacks, the front of the knife should have a waste-stripping device.

In another embodiment of the invention, the front part of the table, on which the trimmed paper rests, is a board supported on a separate framework from which it can be tipped up perpendicular to the trimming plane. The gap in this case is generated by tipping up the front part of the board instead of by sliding the two parts of the table apart. After the edges or interior of a stack have been trimmed, the board is tipped up to slide the waste strips that have dropped onto it into the gap. The advantage of making the front part of the table in two separate pieces is that not as much mass will have to be lifted when the board alone is tipped up as would be necessary if the front part of the table had to be tipped up as a whole.

In another special embodiment of the invention, the end of the upper surface of the board that faces the rear part of the table can be raised above or lowered below the upper surface of the rear part. When it is below the surface of the rear part, a sheet of paper, cardboard, or similar material can be laid on the board, and pads of labels produced in the cutting process can be pushed onto the sheet with the feed mechanism and if necessary with the straightedge as well. When there is an appropriate number of label pads on the sheet, they can easily be transported for further processing. The extent to which the board can be lowered below the upper surface of the rear part of the table should be continuously adjustable. This will permit sheets of any thickness to be laid on the board without the risk of a stack that is to be trimmed and that is being pushed by the feed mechanism toward the front part of the table after trimming striking the edge of the sheet facing the rear part of the table and without the formation of enough of a drop from the rear part of the table onto the top of the sheet to displace any of the labels in the stack after they have been trimmed. The sheet can also be fastened to the board with a vacuum.

The board can be lifted above the surface of the rear part of the table to remove a pad of labels, or the pads just trimmed, from the base strip, to which the bottom labels tend to adhere in accordance with the material properties of the material being cut, the position of the knife in relation to the base strip at the bottom dead center of the cutting cycle, and the sharpness of the edge. The labels tend to adhere to the rail because when the edge of the knife is separating the bottom sheets it penetrates to some extent into the base strip and the bottom sheet, or several sheete if the paper is thin, gets stuck in the incision. The lower sheets will especially tend to get stuck when the knife has gottom slightly dull. When sheets stick in the incision, the label pads will not fall on the front part of the table when the two parts separate but will drop into the gap between them and get squeezed by the rising straightedge, interfering with automatic operation and getting damaged.

The raising and lowering of the upper surface of the board should be automatically controlled in sequence with the cutting program.

In the embodiment in which the front part of the table is a board supported on a separate framework, the board should, as in the embodiment employing a one-piece front part, removable from the base so that the trimmed material can be conveyed directly to the next work station. It will be especially economical in such a device to transport the board mechanically, hydraulically, or pneumatically in sequence with the cutting program.

Other characteristics of the invention are described with reference to the figures and in the subsidiary claims. All of these individual characteristics and all combinations of them are essential to the invention.

The figures illustrate several embodiments of the invention as examples only, without restricting its scope in any way.

Figure 2:
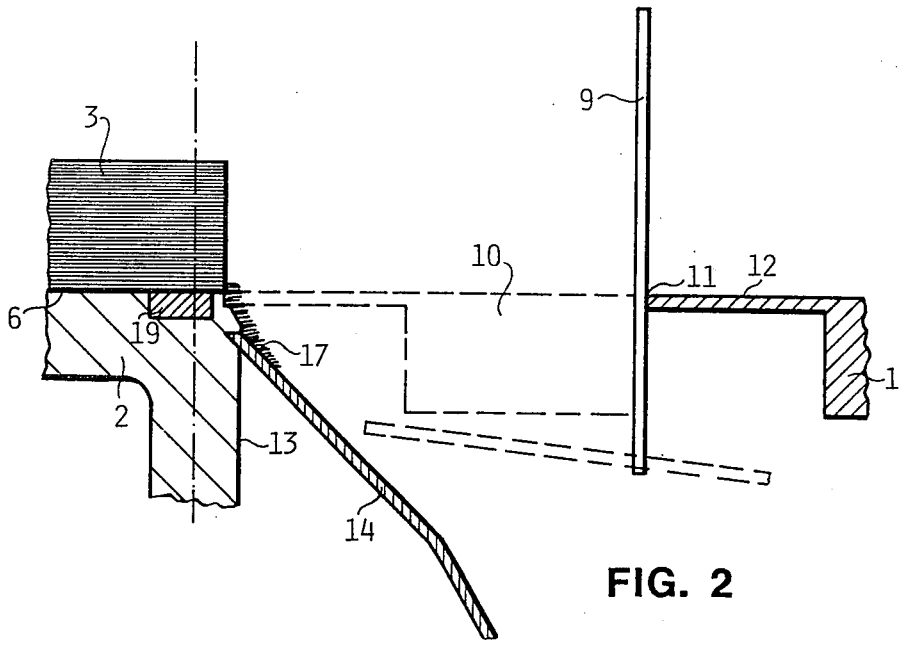
Figure 3:
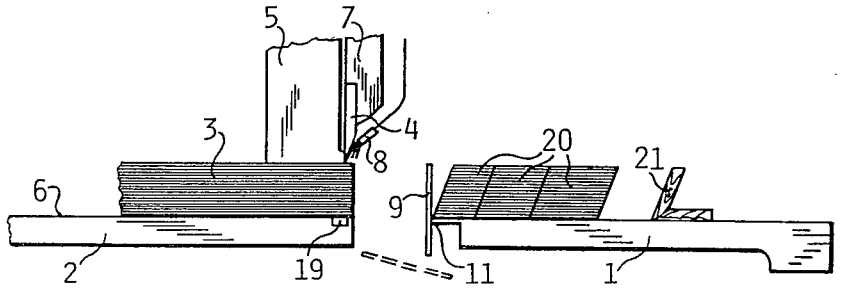
Figure 4:
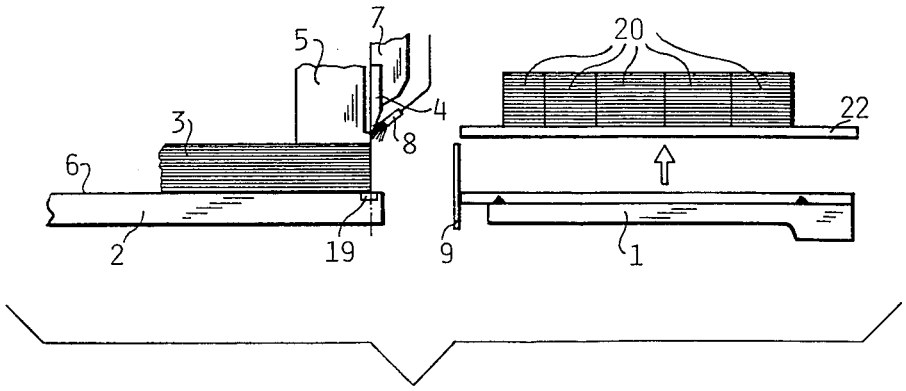
Figure 5:
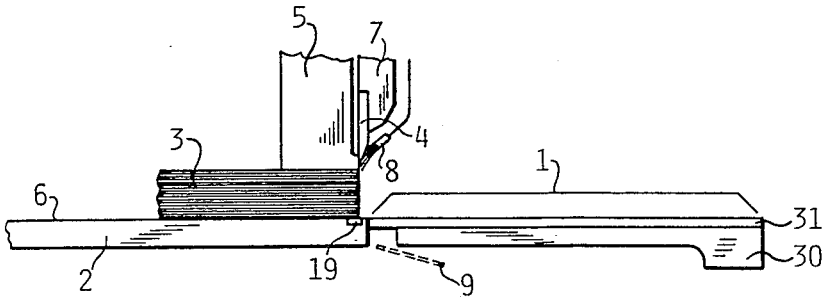
Figure 6:
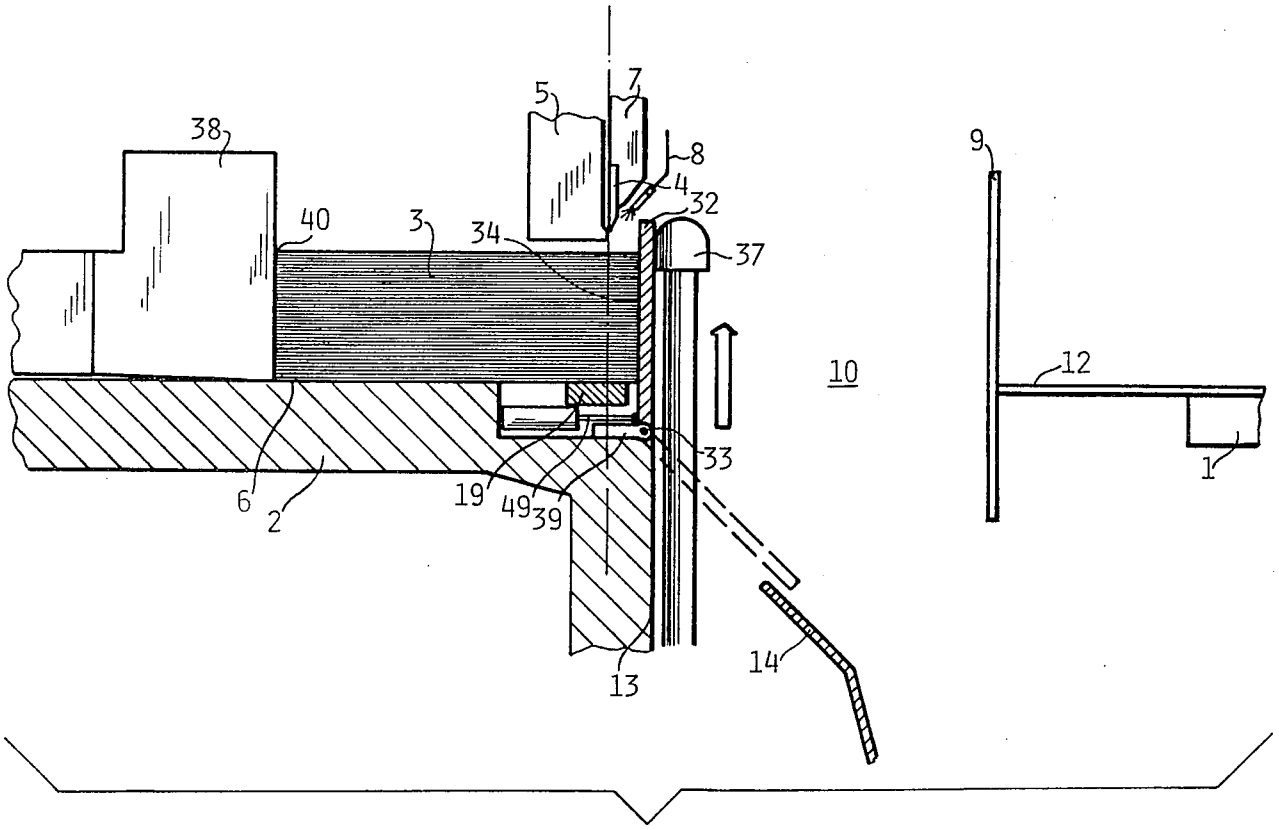
Figure 7:
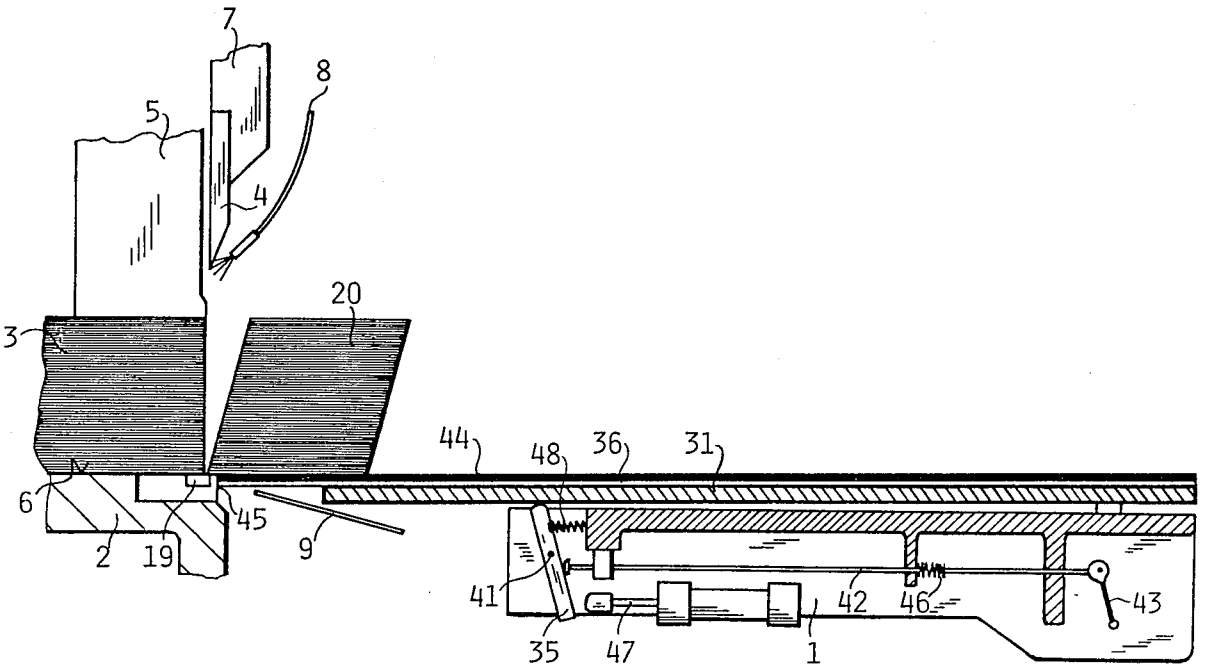
Figure 8:
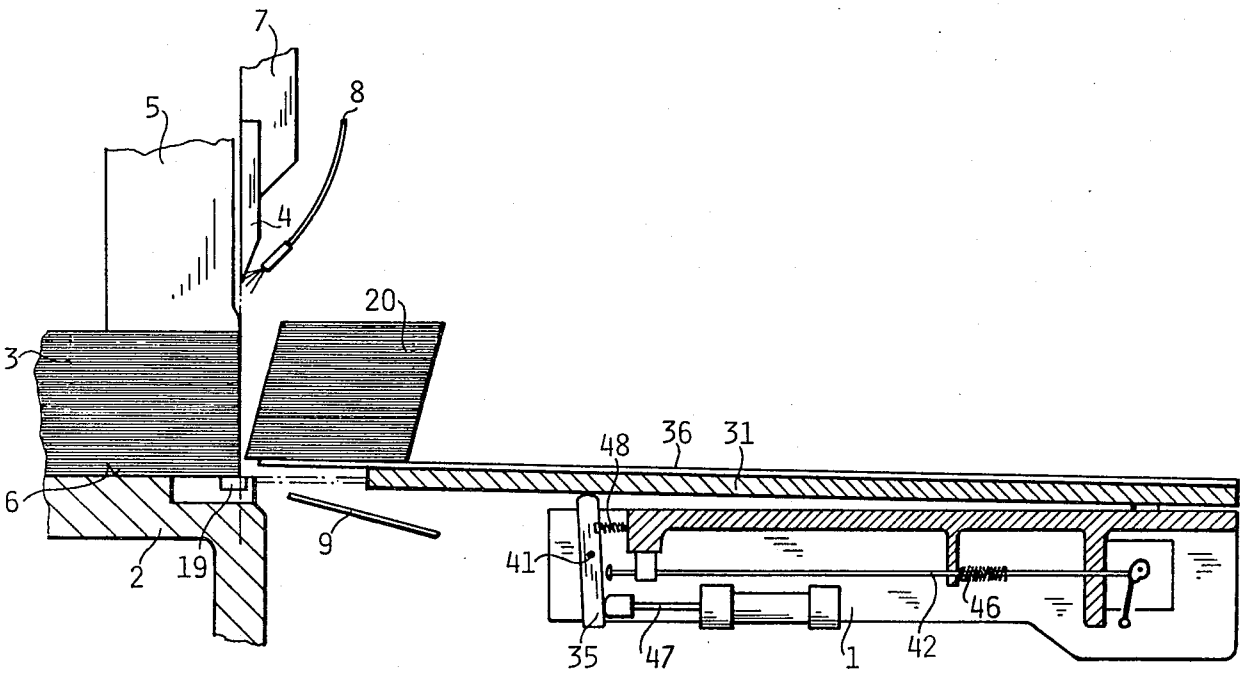

FIG. 1 shows a diagram of one embodiment of the invention with the table separated and while the edges are being trimmed, FIG. 2 a detail of the trimming zone in a section through the device in FIG. 1, FIG. 3 a diagram of the device in FIG. 1 with the table separated and subsequent to the main trim, FIG. 4 a diagram of a device in accordance with the invention and with a removable board on the front part of the table, FIG. 5 a diagram of a second embodiment of the invention in which the front part of the table consists of a board resting on a base, FIG. 6 a diagram of a third embodiment of the invention with a folding two-part sheet-metal guide, FIG. 7 a diagram of a fourth embodiment with a board that can be raised and lowered and that is represented in the lowered position, and FIG. 8 a diagram of the device in FIG. 7 with the board in a raised position.

As is evident from FIG. 1, the device in accordance with the invention consists of a trimming table with a moving front part 1 and an immovable rear part 2. A stack 3 of paper that is to be trimmed is resting on rear part 2. A clamping bar 5, in the vicinity of the knife 4 and only partially represented, clamps stack 3 against the top surface 6 of rear part 2 to ensure optimal trimming. working in conjunction with clamping bar 5, a knife mount 7 encloses knife 4 and guides it precisely as it cuts. In the vicinity of the front of the knife is a waste stripper 8 that removes strips of paper that adhere to the knife as the result of static electricity. It is practical for stripper 8 to be a strip of felt or a brush and for any strips of waste adhering to the knife to be removed as a result of the relative motion of knife and stripper. There is a straightedge 9 mounted under front part 1 at the plane separating front and rear parts 1 and 2. When the two parts of the table are together, straightedge 9 is in its rest position shown by the dashed lines. When the two parts separate to produce gap 10, straightedge 10 moves from its rest position into the operating position shown by the solid lines. In this position it rests against the rear edge 11 of the front part 1 of the table and perpendicular to the upper surface 12 of part 1, on which the trimmed stacks of paper rest, and extends along the whole length of the plane of separation. The straightedge is moved into its operating position by mechanisms that are not shown in reaction to the motion of front part 1 away from rear part 2. There is a sheet metal guide 14 mounted on the front edge 13 of rear part 2 and extending along the full length of the plane of separation. Strips of waste paper left over in trimming the edges and interior of a stack, as described later, will fall through gap 10 and be diverted by this guide 14 directly into a waste receptacle 15. A practical position for this receptacle 15 for collecting waste is directly in the plane separating the front part 1 of the trimming table from the rear part 2. As is evident from FIG. 1, receptacle 15 is connected to a suction device 16 that removes the waste and that can be replaced, however, by another type of waste-removal mechanism like a conveyor belt or worm. It is also conceivable for such waste-removal mechanisms to be controlled by a timer in such a way as to operate only when the two parts of the table are separated. The advantage of such controls is that operating personnel will not be unnecessarily disturbed by noise generated for example by a suction device.

The operation of the cutter will now be described with reference to FIGS. 1 through 8.

Before a stack 3 of paper, collated sheets for example, can be cut, its edges must be trimmed. This stage is represented in FIG. 1. Paper stack 3 rests on the rear part 2 of the table, along which it is advanced a distance corresponding to the width of the strip 17 to be cut off by a feed mechanism that is not shown. Front part 1 simultaneously moves away, opening gap 10, while straightedge 9 moves into the operating position shown in FIGS. 1 and 2. Clamping bar 5 presses down on stack 3 and knife 4 trims strips 17 from stack 3 while it is under pressure, with knife edge 18 coming into contact with the base strip 19 mounted in rear part 2. Straightedge 9, which is upright during the cutting process, prevents knife 4 from throwing waste onto the upper surface 12 of the front part of the table when brittle material is being cut. Thus, strips 17 that have been trimmed off can only fall through gap 10 and along guide 14 into waste receptacle 15. If any strips adhere to knife 4, they will be removed by waste stripper 8 as previously described.

As illustrated in particular in the detail of the cutting zone in FIG. 2, base strip 19 is not located immediately at the front edge 13 of rear part 2 but parallel to and at some distance back from it. This is necessary because of the forces generated in cutting. The result is that trimmed-off strips 17 may adhere to the front edge 13 of rear part 2 and not drop into waste receptacle 15. Accordingly, as shown in FIG. 2, an intermediate feed movement of stack 3, subsequent to the trimming of the edge, has been built into the system. After strips 17 have been cut off as shown in FIG. 1, knife 14 and clamping bar 5 move into a rest position, which is not shown. In this position, the cutting plane of knife 4 is at the location shown by the dotted and dashed line in FIG. 2. Thus, the paper stack 3 to be trimmed will be in the position in which its cutting plane coincides with the dotted and dashed line. To ensure that trimmed-off strips 17 fall into waste receptacle 15, if they have not already been automatically pushed into it by the forward-direct wedge action of knife 4, the intermediate feed movement propels stack 3 forward, after which the stack will be in the position shown in FIG. 2, in which it will have pushed any strips 17 remaining in the cutting zone over the front edge 13 of the rear part 2 of the trimming table.

The other edges of stack 3 are similarly trimmed, the stack being rotated into the correct positions by the operating personnel. This is facilitated by a cushion of air between stack 3 and the front part 1 of the table and produced by air nozzles, which are not shown, in the front part or in the back part.

In FIG. 2 the position of front part 1 and straightedge 9 when the two parts of the table are together is represented by the dashed line.

FIG. 3 shows how the interior cuts are made. Once the edges have been trimmed and the intermediate feed carrier out as shown in FIG. 2, the front part 1 of the table is moved back toward the rear part 2 into the closed position. Straightedge 9 swings back out of its upright position into its rest position under front part 1 until the rear edge 11 of front part 1 comes into contact with the rear part 2. Gap 10 between the two parts 1 and 2 closes. The feed mechanism advances the stack 3 of paper to be cut toward front part 1 a distance corresponding to the width of the cut. The stack is cut in the usual way as described in connection with the edge trimming with reference to FIG. 1, producing a cut stack 20 of paper. The bottom sheet in stack 20 now, as a result of the position of the cutting plane previously described, not only rests on front part 1 but also slightly overlaps the upper surface 6 of rear part 2. Because the knife is slightly wedge-shaped, the profile of cut stack 20 along the cutting plane will be a parallelogram.

After cutting, front part 1 will separate mechanically, hydraulically, or pneumatically from rear part 2. As it separates, straightedge 9 will move from its rest position into its operating position. As previously described, straightedge 11 in this position lies against the rear edge 11 of front part 1 and at a right angle to the surface 12 on which the paper rests. As straightedge 9 moves into its operating position it pushes cut stack 20, which already lies over the edge of front part 1, completely onto part 1. This prevents cut stack 20 from getting caught in gap 10 as the gap closes up again during the subsequent stages that will be described below.

If an interior cut is to be made subsequent to the process just described in which paper stack 20 was separate, straightedge 9 will remain in its vertical position. There it will also serve as a contact surface for registering stack 20 with its parallelogram-shaped profile. It will now be possible for example to apply the operating square 21 to stack 20 to straighten it up against straightedge 9 in its vertical position.

If, subsequent to the main interior cut employed to separate stack 20, a second interior cut is to be made, the paper stack 3 to be cut is now advanced by the width of the strip of paper to be cut off in this second cut. The operation already described in connection with trimming off strips 17 now follows. In detail this consists of lowering clamping bar 5 and doing the actual cutting by lowering knife 4, with the resulting waste strips 17 falling over guide 14 into receptacle 15. Any waste strips 17 adhering to knife 4 will be removed by waste stripper 8 as knife 4 returns to its rest position. Here again, straightedge 9 prevents knife 4 from throwing waste 17 onto the front part 1 of the table when brittle material is being cut. The previously described intermediate feed follows this second cut to ensure that any waste strips 17 remaining in the cutting zone will be transported to container 15. Gap 10 closes again and straight-edge 9 returns to its rest position. The stack 3 to be cut is advanced and cut, separating another stack 20 from stack 3. Several main cuts interspersed with intermediate cuts as in FIG. 3 will result in a row of cut stacks 20, each of which can be straightened against straightedge 9 by operating square 21 following a main cut or, as shown in FIG. 3, after several main cuts.

If there are no intermediate cuts between the main cuts, it will naturally not be necessary to separate front part 1 from rear part 2. In this case, all cuts will be made in the sequence cut-feed-cut-etc.

FIG. 4 shows a slight alteration in the embodiment of the front part of the table. Here, front part 1 has a removable board 22. Board 22 is connected to front part 1 during the operation by fastening devices that are not shown. Board 22 can be removed from front part 1 so that the cut stack 20 that rests on the board can easily be transported on it for further processing. The advantage of this system is that the operator will not have to carry an unsupported stack of cut paper, which is usually very heavy and hard to handle.

FIG. 5 shows another embodiment of the invention in which the table consists of a front part 1 in the form of a base 30 with a board 31 on which the cut material 20 rests and of a rear part 2 on which the material 3 to be cut rests. This embodiment functions similarly to that described in FIGS. 1 through 4, except that, following trimming or intermediate cutting, the board 31 on top of base 30 can be tipped up at a right angle to the cutting plane to dump the strips 17 of waste left over from trimming or cutting into the resulting gap 10 between board 31 and rear part 2. The tilting mechanism is not illustrated, but can be mechanical, hydraulic, or pneumatic as in the first embodiment. It will also be practical for board 31 to be removable from base 30 as in FIG. 4.

Boards 31 or 22, or generally front part 1 and rear part 2, can be equipped with air nozzles to generate an air cushion between the support and the stack of paper resting on it. Finally, to prevent the operators' hands from getting pinched, the device can be provided with an automatic safety device like a light barrier that would be interrupted when the operators' hands entered the danger zone and decelerated or stop the motion of front part 1 or board 31 in closing gap 10.

FIG. 6 is a diagram of a third embodiment with a two-part sheet-metal guide that folds upward. Guide 14 is designed so that one section 32 can be folded up around the axis of rotation 33 of a bearing 39 on the front edge 13 of rear table part 2 against the side 34 of the stack 3 that is to be cut that faces the front part 1 of the table by a pneumatically, hydraulically, or magnetically activated slide 37. This occurs after front part 1 has separated from rear part 2, when straightedge 9 is in the operating position, and the strips of waste left over from trimming or cutting have been pushed into gap 10 by the forward motion of feed mechanism 38. In the position represented by the solid lines, the folding section 32 of guide 14 presses against the remainder stack of material 3 to be cut that rests on rear part 2. Thus, the material 3 that is to be cut and that has, during preliminary clamping and trimming, been displaced more or less in accordance with its material properties from the front surface 40 of feed mechanism 38, which determines format, can be exactly positioned against it again without manual intervention. In FIG. 6, the folded-down position of folding section 32 is represented by the dashed line. The mechanism that powers slide 37 is not essential to the invention and has not been illustrated. Section 32 is folded down into the position represented by the dashed line by a pneumatically, hydraulically, or magnetically activated slide 49 or spring device in rear table part 2. Slides 37 and 49 should be discontinuously activated if necessary to make section 32 knock against the stack to jog the different layers of material, especially if they have rough surfaces, and straighten out the stack.

FIGS. 7 and 8 are diagrams of a fourth embodiment, in which the board on the front part of the table can be raised and lowered. The side of board 31 that faces rear part 2 is raised or lowered. This is done with a lever 35 mounted on an axis of rotation 41 below the side of front part 1 that faces rear part 2. The position of lever 35 determines the level to which front part 1 and hence board 31 is raised or lowered.

In FIG. 7 board 31 is in its lowered position. It is lowered with an eccentric lever 43 that activates lever 35 through an intermediate rod 42. The side of board 31 that faces rear part 2 can be continuously lowered below the upper surface 6 of rear part 2 in accordance with the position of eccentric lever 43. This makes it possible to lay a sheet 44 of paper, cardboard, or similar material on the upper surface 36 of board 31 and stacks 20 of paper produced in the cutting process can be pushed into sheet 44 with the feed mechanism and with straightedge 9. When there is an appropriate number of cut stacks 20 on sheet 44, they can easily be transported for further processing. Lowering the edge of board 31 that faces rear part 2 will permit sheets 44 of any thickness to be laid on the board without the risk of a stack 3 that is to be cut and that is being pushed by the feed mechanism toward the front part of the table after trimming striking the edge 45 of the sheet 44 facing the rear part 2 of the table and without the formation of enough of a drop from the rear part of the table onto the top of the sheet to displace any of the sheets in stack 20 after they have been cut. A spring mechanism 46 forces intermediate rod 42 against the eccenter of eccentric lever 43. It is also conceivable to apply pneumatic, hydraulic, or magnetic devices to the eccenter to move intermediate rod 42.

FIG. 8 shows board 31 in the raised position. Board 31 is raised, not as in the embodiment shown in FIG. 7 by an intermediate rod, but by a pneumatically hydraulically, or electromagnetically activated slide 47 in front part 1 of the table. In the raised position shown in FIG. 8, slide 47 is part of a mechanism that includes lever 35, which pivots around an angle defined by the predetermined stroke of slide 47 and thus lifts board 31 to a specific level above the upper surface 6 of the rear part of the table. Lifting board 31 will remove a stack, or the stacks 20 just trimmed, from base strip 19, to which the bottom sheets tend to adhere in accordance with the material properties of the material being cut, the position of the knife in relation to the base strip at the bottom dead center of the cutting cycle, and the sharpness of the edge. When slide 47 does not apply lever 35, a compression spring 48 in front part 1 restores lever 35 to its position against intermediate rod 42 where it assumes a specific position in relation to the upper surface 6 of rear part 2. In this position, the upper surface 6 of rear part 2, the upper surface 36 of board 31, and the upper surface of sheet 44 lie in one plane. FIG. 7 shows slide 47 retracted.

We claim:

1. Device for cutting paper, cardboard, and similar materials, comprising: a cutting table; feed means for advancing material to be cut to a desired extent along said cutting table, an intermediate cut being carried out both when the edges are trimmed and subsequent to at least one main cut; said cutting table comprising a front part for supporting trimmed material and a rear part for supporting material to be trimmed, said front and rear parts being slidable apart to leave a gap; a straightedge member being positioned under said front part of the table at a plane of separation between said two parts in a rest position when they are together, said straightedge member moving when the two parts separate from said rest position into an operating position, said straightedge lying in said operating position in contact with the total length of a rear edge of said front part of the table and at a right angle to the upper surface of said table.

2. Device as defined in claim 1, wherein said two parts of the cutting table slide apart before the edges are trimmed and the intermediate cut made.

3. Device as defined in claim 1, wherein the width of said gap occurring when the two parts of the table are separated is variable so as to be a multiple of the width of the waste strips resulting from both edge trimming and intermediate cutting.

4. Device as defined in claim 1, wherein said front part of the cutting table can be raised at a right angle to the cutting surface of said rear part.

5. Device as defined in claim 1, wherein said front part of the cutting table moves in sequence with a cutting program.

6. Device as defined in claim 1, wherein said front part of the cutting table has a removable board.

7. Device as defined in claim 1, including a receptacle under said cutting table in the vicinity of the plane separating the front part of the table from the rear part of the table, and a sheet-metal guide between said receptacle and said gap to collect waste paper.

8. Device as defined in claim 7, wherein said guide has a folding section in neighborhood of the front edge of the rear part of said table for registering the material to be cut and supported on the rear part of said table.

9. Device as defined in claim 8, wherein said folding section can be folded up around an axis of rotation parallel to the front edge of said rear part against a side of the material to be cut and faces the front part of the table.

10. Device as defined in claim 7, wherein said receptacle is connected to waste-removal means.

11. Device as defined in claim 1, including a knife for cutting the material and a waste-stripping means on the front of said knife.

12. A device as defined in claim 1, wherein said two parts of the cutting table slide apart before the edges are trimmed and the intermediate cut made, the width of said gap occurring when the two parts of the table are separated being variable so as to be a multiple of the width of the waste strips resulting from both edge trimming and intermediate cutting, said front part of the cutting table being raisable at a right angle to the cutting surface of said rear part, said front part of the cutting table moving in sequence with a cutting program, said front part of the cutting table having a removable board, a receptacle under said cutting table in the vicinity of the plane separating the front part of the table from the rear part of the table, and a sheet-metal guide between said receptacle and said gap to collect waste paper, said guide having a folding section in neighborhood of the front edge of the rear part of said table for registering the material to be cut and supported on the rear part of said table, said folding section being foldable around an axis of rotation parallel to the front edge of said rear part against a side of the material to be cut and facing the front part of the table, said receptacle being connected to waste-removal means, waste-stripping means on the front of said knife.

* * * * *